US007355328B2

(12) United States Patent
Botzer et al.

(10) Patent No.: US 7,355,328 B2
(45) Date of Patent: Apr. 8, 2008

(54) SHORT-ARC LAMP WITH DUAL CONCAVE REFLECTORS AND A TRANSPARENT ARC CHAMBER

(75) Inventors: Shabtai Botzer, Kiriyat Motzkin (IL); Yigal Finkelstein, Kiriat Haim (IL); Arnon Zelman, Haifa (IL); Meir Rosenfeld, Nahariya (IL); Rafael Sarfati, Haifa (IL); Edith Bresauer, Kiriat Tivon (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 10/508,080

(22) PCT Filed: Mar. 6, 2003

(86) PCT No.: PCT/IL03/00183

§ 371 (c)(1),
(2), (4) Date: May 12, 2005

(87) PCT Pub. No.: WO03/079391

PCT Pub. Date: Sep. 25, 2003

(65) Prior Publication Data

US 2005/0206319 A1 Sep. 22, 2005

(30) Foreign Application Priority Data

Mar. 19, 2002 (IL) ..... 148766

(51) Int. Cl.
*H01J 61/40* (2006.01)
*F21V 7/00* (2006.01)

(52) U.S. Cl. ..... 313/114; 313/113; 362/297; 362/304; 362/305

(58) Field of Classification Search ..... 362/296, 362/297, 304, 609, 623, 624, 241; 313/110, 313/113, 114, 318.11
See application file for complete search history.

(56) References Cited

U.S. PATENT DOCUMENTS

| | | | | |
|---|---|---|---|---|
| 3,766,421 | A * | 10/1973 | Bonazoli et al. | 313/113 |
| 3,835,342 | A * | 9/1974 | Freeman | 313/114 |
| 4,281,267 | A * | 7/1981 | Johnson | 313/25 |
| 4,575,636 | A * | 3/1986 | Caprari | 250/492.1 |
| 5,211,473 | A * | 5/1993 | Gordin et al. | 362/297 |
| 5,418,420 | A * | 5/1995 | Roberts | 313/114 |
| 5,525,856 | A * | 6/1996 | Kawai et al. | 313/114 |
| 6,304,693 | B1 * | 10/2001 | Buelow et al. | 362/298 |
| 6,744,187 | B1 * | 6/2004 | Wimberly | 313/110 |
| 2002/0145875 | A1 * | 10/2002 | Roberts et al. | 362/294 |
| 2005/0218769 | A1 * | 10/2005 | Ritz et al. | 313/113 |

* cited by examiner

*Primary Examiner*—Peter Macchiarolo
(74) *Attorney, Agent, or Firm*—Mark M. Friedman

(57) ABSTRACT

A short arc lamp with two transparent apertures. The lamp includes a sealed transparent arc chamber with an internal integral light reflector, and an external light reflecting element positioned external to the sealed arc transparent chamber.

25 Claims, 3 Drawing Sheets

SHORT-ARC LAMP WITH DUAL CONCAVE REFLECTORS AND A TRANSPARENT ARC CHAMBER

FIELD AND BACKGROUND OF THE INVENTION

The present invention relates to arc lamps and, more particularly, to a short arc lamp featuring a transparent sealed arc chamber with internal and external integral concave reflecting elements reflecting light from the arc in the same direction.

A short arc lamp generally features basic components of an anode and a cathode separated by a gap, commonly known as an arc gap, which is positioned along the center longitudinal axis of a gas pressurized chamber where a concave, typically, parabolic reflector element is internal or external to the gas pressurized chamber.

During operation, a high voltage is applied across the gap resulting in an electrical arc being produced along the arc gap with simultaneous intense emission of light originating from the excited gas. The emitted light diverges onto, and is collimated by the concave reflector element, and exits through the transparent window of the short arc lamp, thereby providing an intense collimated source of light for a particular. application.

There are basically two configurations for constructing short arc lamps:

The first configuration includes teachings of U.S. Pat. Nos. 4,633,128, 5,561,338, 5,418,420, and 5,399,931, to Roberts et al., of U.S. Pat. Nos. 4,940,922, and 4,724,352 to Schuda et al., and of U.S. Pat. No. 5,869,920 to Kavanagh.

In each of these short arc lamp teachings, the arc chamber (which confines a vacuum tight volume by an integral parabolic reflector surface and a transparent window), is constructed from a hollowed out portion of opaque solid material, typically, solid ceramic material, in order to withstand gas pressures of more than several atmospheres.

A common limitation of short arc lamps in general is their high sensitivity to the locus and shape of the light source, because of the short focal length of their reflector.

This is so unless short arc lamps having large reflectors are employed, however the construction of large arc chambers which are needed in this configuration to accommodate large reflectors is costly and technologically difficult to implement, thus a second configuration is used; that of short arc lamps featuring an arc chamber confined within a transparent envelope made of glass or quartz at relatively high gas pressures and which have an external reflector.

Such short arc lamps are described in U.S. Pat. No. 5,369,557, issued to Ronney and in U.S. Pat. No. 4,734,829, issued to Wu et al.

In each of these teachings, in which the reflecting surfaces of light are positioned only external to the arc chamber envelope, the transparent envelope has the advantage of an efficient transmission of light to the external reflector.

Yet a portion of the radiation of the discharge, in the backward direction, is prevented from reaching the external reflector by the parts of the discharge chamber itself and therefore radiation losses occur.

Thus, it seems beneficial to have a novel third configuration of a short arc lamp which will substantially resemble the second configuration, but which avoids its limitation. I.e., it would be useful to have a short arc lamp featuring a transparent sealed arc chamber, which does not suffer from the aforementioned radiation losses.

In addition, a common feature to the short arc lamps of both first and second configurations which were described above is that the light wavelength spectrum along the beam cross section is usually uniform. An exception to this is a beam of light with different colors which was formed by an arc lamp which incorporated two different light sources as described e.g. in U.S. Pat. No. 5,655,832 to Pelka, et al.

Still, there does not exist nowadays a short arc lamp in which the radiation which is being emitted from a single arcing chamber is split to form a beam of light having a profile of two concentric regions in which the inner region has one waveband, e.g. in the infrared and the outer region has a second wavelength band, e.g. in the vis/uv.

The present invention fulfills this gap and provides other related advantages.

SUMMARY OF THE INVENTION

The present is a short arc lamp, which has two transparent sections: a flat window and a cylindrical tube. The window and the tube may be made of different materials, to be transparent in different wavelength bands for example, in the visible and in the infrared. Within the arc chamber, behind the anode is an internal concave reflector, for reflecting light from the arc via the flat window. Outside the arc chamber is an external concave reflector for reflecting light that emerges via the cylindrical tube.

Both reflectors reflect the light in the same direction to produce a nearly collimated beam having a divergence angle which is related to the electrodes gap and to the arc chamber geometry.

The collimated beam is a superposition of two distinct concentric beams of light reflected substantially in the same direction, wherein each beam can have a characteristic wavelength band, e.g. the first beam in the uv/visible and the second beam in the infrared.

In accordance with the present invention there is provided a short arc lamp with two transparent apertures, the lamp comprises of: (a) a sealed transparent arc chamber having an internal integral light reflector, and (b) an external light reflecting element positioned external to the sealed arc transparent chamber.

In accordance with the present invention the sealed transparent arc chamber includes: (i) an anode; (ii) a cathode, both anode and cathode extending lengthwise along the center axis of the sealed transparent arc chamber, whereby tip of the cathode faces opposite to tip of the anode, the anode and the cathode are separated by a gap defining an arc gap of the short arc lamp; (iii) a transparent tube extending lengthwise along and symmetrical with respect to the center axis of the sealed arc chamber, for providing a volume to the sealed arc chamber, the volume of the transparent tube confines the anode, the cathode, and the internal integral concave reflecting element, the transparent tube transmits outwards at least part of the light generated within the sealed arc chamber; (iv) a base joined to the anode end of the transparent tube, for supporting the internal integral concave reflecting element and the anode, and for enabling gas tight closure of an anode end of the sealed arc chamber, and (v) a transparent window joined to cathode end of the transparent tube, for transmitting light reflected and collimated by the internal integral concave reflecting element out of the short arc lamp and for enabling gas tight closure of cathode end of the sealed arc chamber.

Other benefits of the present invention will become apparent upon reading the following description in conjunction with the following figures.

BRIEF DESCRIPTION OF THE DRAWINGS

The invention is herein described, by way of example only, with reference to the accompanying drawings, wherein.

DESCRIPTION OF THE PREFERRED EMBODIMENTS

The present embodiments herein are not intended to be exhaustive and to limit in any way the scope of the invention; rather they are used as examples for the clarification of the invention and for enabling of others skilled in the art to utilize its teaching.

The short arc lamp of the present invention features a unique combination of a transparent sealed arc chamber with an internal integral concave reflecting element and an external integral concave reflecting element, where both reflecting elements reflect radiation from the arc in the same direction.

Figure 1:
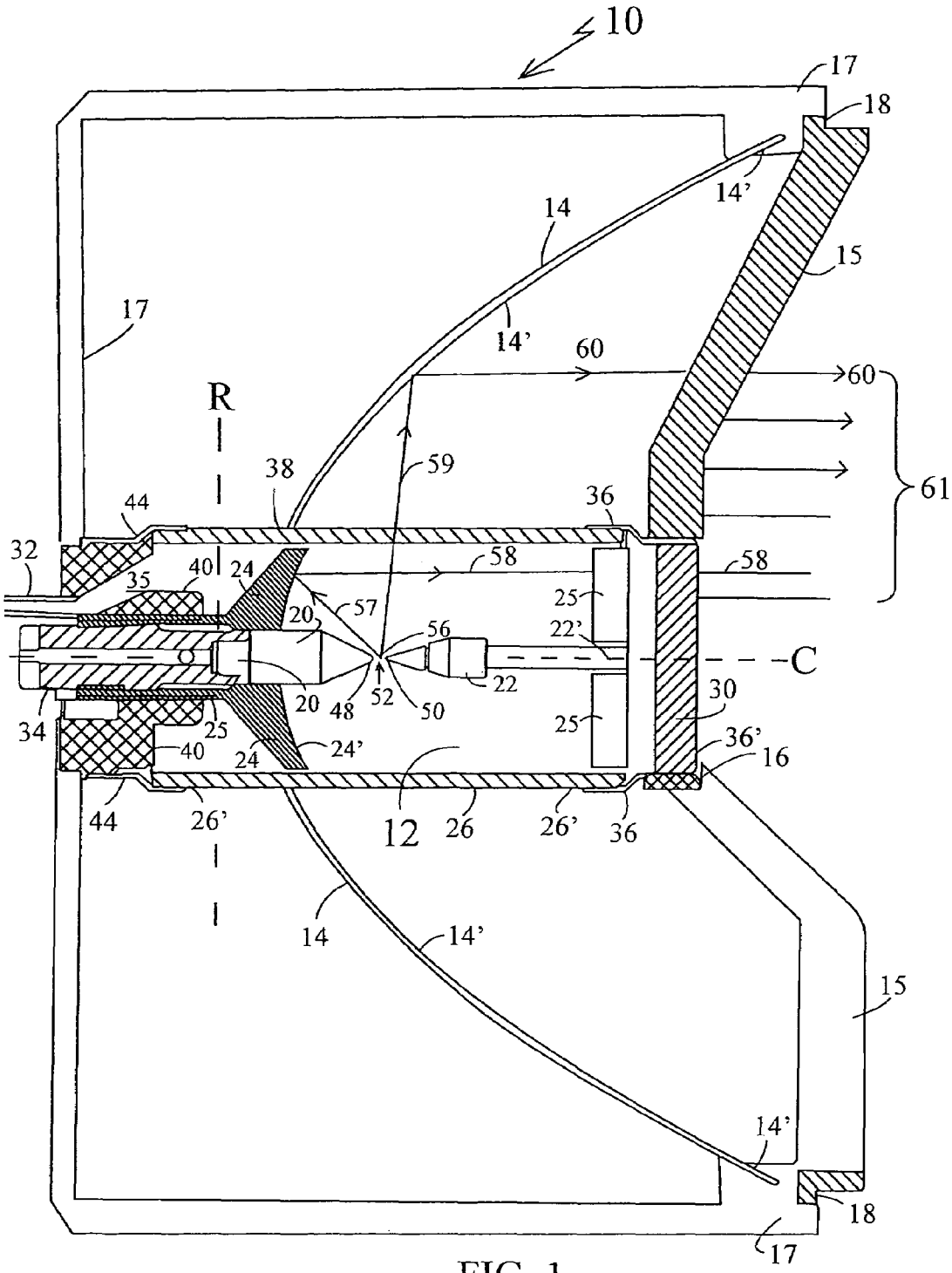
FIG. 1 shows a longitudinal section side view of the short arc lamp.

Referring now to the drawings, FIG. 1 is a schematic diagram illustrating a longitudinal section side view of a preferred embodiment of the short arc lamp of the present invention, generally referenced by 10. Short arc lamp 10 includes a sealed arc chamber 12, and an external concave reflecting element 14.

Sealed Arc Chamber 12

Figure 2:
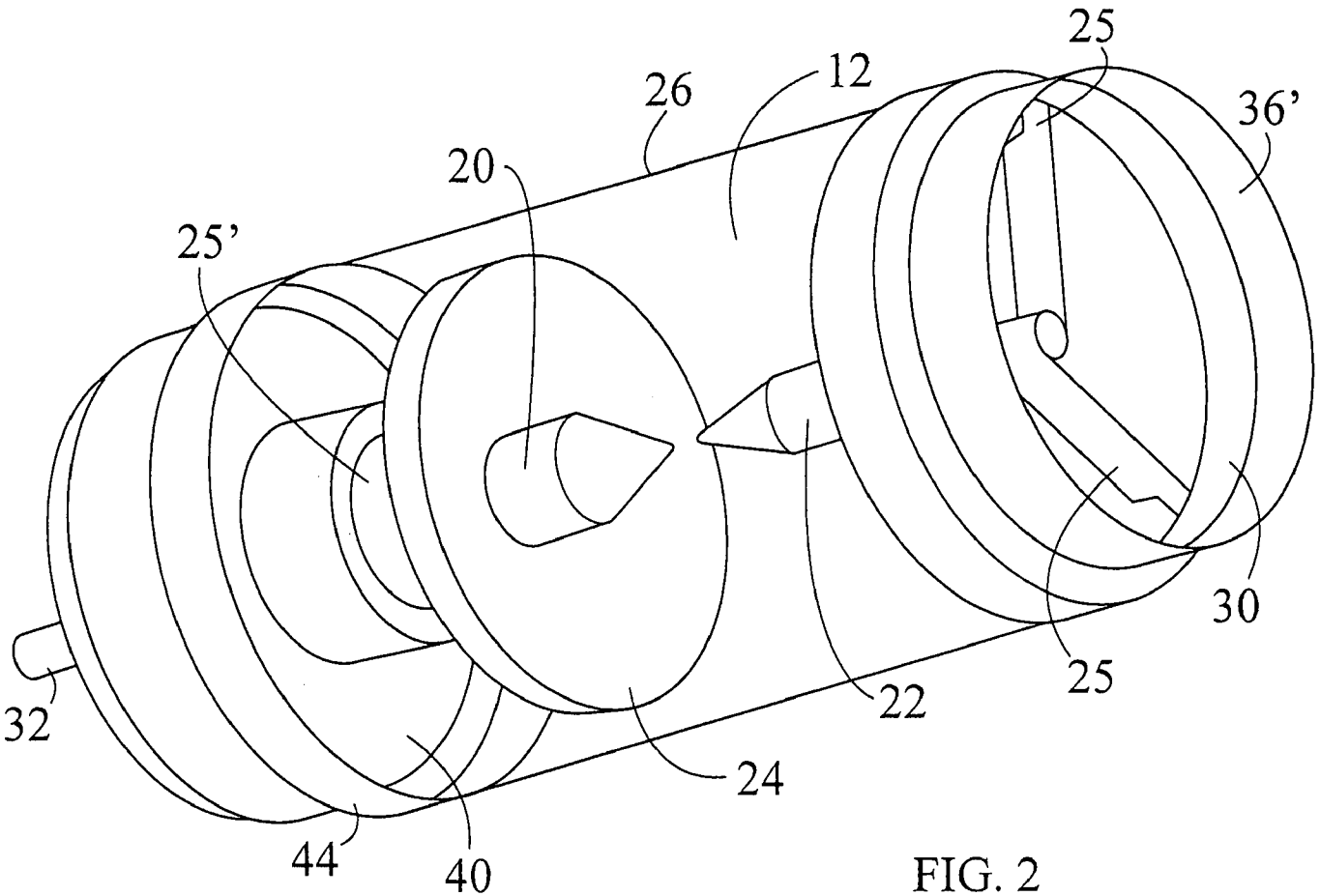
FIG. 2 shows an exploded view of the sealed arc chamber of the short arc lamp and, FIG. 3 shows a traverse front view of the short arc lamp.

Sealed arc chamber 12 which is shown in an exploded view in FIG. 2 to which reference is now made, is a gas-tight cylindrical body which includes the following primary components: an anode member 20, a cathode member 22, an internal concave reflecting element 24, a transparent tube 26, an arc chamber base 40, a transparent window 30, and a gas transport line 32.

Arc chamber 12 further includes additional components: an anode holder 34, a base sleeve 44, a cathode/window sleeve 36, and struts 25 connecting cathode 22 to cathode/window sleeve 36.

In FIG. 1, the longitudinal axis extending along the center of arc chamber 12 is hereinafter referred to by C, and a reference radial direction of sealed arc chamber 12 is hereinafter referred to by R, whereby center longitudinal axis C is perpendicular to reference radial direction R. In a non-limiting example, a length of arc chamber 12 along the C axis is between about 60 to about 150 mm., and a diameter of arc chamber 12 along the R direction is between about 30 to about 60 mm.

Anode member 20 extends lengthwise along center axis C of arc chamber 12. Anode 20 is preferably made of a high melting point metal such as tungsten, molybdenum, tantalum or of an alloy thereof, but may also be made of a non-metallic material, such as graphite, Anode tip 48 has preferably a pointed configuration, but may also have a spherical, conical or a flat configuration.

Non-reflecting part of internal reflecting element 24 is a hollow cylinder 25, which extends lengthwise toward the opposite direction of the emerging beam, and which is threaded into base 40.

Extension 25 accommodates anode holder 34, a tubular insert, preferably made of copper, which embraces a flat end portion 20' of anode 20 for holding rigidly anode 20.

Anode tip 48 and cathode tip 50 facing each other and positioned along center axis C are separated by a gap 52 of length in the range of about 1 mm to about 10 mm, defining the arc gap of short arc lamp 10. A layer of carbon (not shown) is optionally added, according to any known or standard method for carbonizing an electrode, to anode tip 48 and/or to cathode tip 50, for extending electrode lifetime during operation of short arc lamp 10.

Internal integral reflecting element 24 is for reflecting and collimating light generated within sealed arc chamber 12 in the direction of cathode 22 parallel to center axis C of sealed arc chamber 12 through transparent window 30.

Internal integral reflecting element 24 which is symmetrically mounted around anode 20, is concave in the direction facing cathode 22, and is symmetrical with respect to center axis C of sealed arc chamber 12.

Internal integral reflecting element 24 has a reflective surface 24', with a polished appearance, preferably having a parabolic geometrical configuration, but may be elliptical, or of some other a-spherical geometrical configuration.

The size of reflecting element 24 is smaller then the inner diameter of transparent tube 26, in order to allow the reflector to expand when it becomes heated during the operation of sealed arc chamber 12.

Internal integral reflecting element 24 is preferably made of a metal such as copper, nickel or aluminum but may also be made of a non-metal material, such as ceramics having a polished surface and a coating of a metal such as aluminum, rhodium or silver to yield an appropriate reflectivity.

Internal integral reflecting element 24 features a focal point 56 preferably located near or at the end of cathode tip 50, on center axis C. During generation of a short arc, part of the light emerging at focal point 56 diverges onto, and is collimated by, reflective surface 24' of internal integral concave reflecting element 24

Cathode/window sleeve 36 is a metallic tailpiece, which is preferably made of kovar (an iron cobalt nickel alloy) and which is vacuum-tightly mounted on cathode end 26' of transparent tube 26 by brazing or adhesive bonding.

Cathode 22 is rigidly positioned in the center of transparent tube 26 by struts, which preferably consist of three metallic arms 25, and which are thin enough not to obstruct a beam of light traveling along sealed arc chamber 12.

Arms 25 are attached on one of their side to the interior part of cathode/window sleeve 36 and on their other side they embrace the non tip end 22' of cathode 22 to hold cathode 22 firmly in place.

Arms 25 are preferably made of a refractory metal such as molybdenum or tungsten. Attached to arms 25 are thin strips (not shown) of a zirconium metal which act as a getter for impurities in the gas which fills arc chamber 12.

Cathode 22 extends lengthwise along center axis C of sealed arc chamber 12 wherein cathode tip 50 faces tip 48 of anode 20. Cathode 22 is preferably made of a high melting point metal with a low electron work function such as thoriated (alloyed with thorium oxide) tungsten, but can also be made of a non-metallic material, such as graphite or lanthanum hexa-boride. Cathode tip 50 is preferably of a pointed configuration, but may also be of a spherical or conical configuration.

The collimated light is in the form of parallel light rays 58 with a typical cross section slightly narrower than the diameter of the tube, e.g. between about 30 mm, to about 50 mm, exiting through transparent window 30 out of short arc lamp 10.

Transparent tube 26 is transparent to light having a selected wavelength band and is used for transmitting light to be reflected by external reflecting element 14 (see below).

Transparent tube 26 is made of a material selected from the group consisting of sapphire (transparent in the region of between about 0.14 microns to about 6 microns), quartz (transparent in the region of between about 0.12 microns to about 4 microns), zinc sulfide (transparent in the region of between about 0.5 microns to about 12 microns) or zinc selenide (transparent in the region of between of about 0.5 microns to about 20 microns), and has a wall thickness which safely withstands the internal gas pressure which is confined within it.

Base 40 which accommodates the inner reflector/anode assembly, extends parallel to radial axis R extending substantially across the length of the inner diameter of transparent tube 26 and is symmetrical with respect to center axis C of sealed arc chamber 12. Base 40 which is made of a metal, preferably such as stainless steel, is vacuum tightly welded to a base sleeve 44 which is made of kovar (an iron nickel cobalt alloy) and which is vacuum tightly brazed or glued to the anode end 26" of transparent tube 26.

Transparent window 30 located at cathode end of transparent tube 26, has a disk form, with diameter in radial axis direction R extending across the inner diameter of transparent tube 26, with flat sides in the radial axis direction R, and is symmetrical with respect to center axis C of sealed arc chamber 12.

Transparent window 30 is used for transmitting light reflected and collimated by internal integral reflecting element 24 out of short arc lamp 10, and for enabling gas tight closure of the cathode end 26' of sealed arc chamber 12. Transparent window 30 is made of a material transparent to light having a selected wavelength. Thickness of transparent window 30 is selected to withstand relatively high gas pressure.

In particular, transparent window 30 is of a material selected from the group consisting of quartz, sapphire, zinc sulfide, zinc selenide, germanium, or of a combination of these.

Transparent window 30 is vacuum tightly connected, e.g. glued or brazed, to the internal surface 36' of cathode/window sleeve 36.

A gas transport line 32, preferably tubular, vacuum tightly fitted into and extending through base 40, is for transporting the gas into and out of the void volume of sealed arc chamber 12 via channel 35 in base 40.

Gas transport line 32 is made of a metallic tube, such as copper or stainless steel.

A gas (not shown) occupies the void volume of sealed arc chamber 12 for being excited by the short arc formed across the gap between the electrodes.

Following electronic excitation, the gas is emitting light having characteristic wavelength bands.

The gas is either a pure gas or a mixture of gases, for example, a gas selected from the group consisting of xenon gas, argon gas, neon gas and, and mixture thereof pressurized from atmospheric pressure up to about 20 atmospheres.

Electrical connection to arc lamp 12 is made by applying electrical connectors having positive (or ground) and negative polarity to base 40 and to cathode/window sleeve 36 respectively.

External Integral Reflecting Element 14

External reflecting element 14, equivalently referred to as external reflector of short arc lamp 10, is located externally and symmetrically mounted around the outer wall of transparent tube 26. Its location in the C direction with respect to sealed arc chamber 12 can be slightly adjusted (see below).

Reflecting surface 14' of external integral reflecting element 14, is concave in the direction facing cathode 22, and is symmetrical with respect to center axis C of sealed arc chamber 12. Concavity of external integral concave reflecting element 14 is preferably parabolic, but may be elliptical, spherical or of some other a-spherical geometrical configuration.

External reflecting element 14 is preferably made of a metal such as nickel or aluminum, but may also be made of a non-metallic material, such as glass, ceramics, or a heat resistive composite smooth material.

The concave reflective surface 14' of external reflecting element 14 facing towards the direction of transparent window 30 is polished and features a reflective layer or coating of a metal such as nickel, aluminum, rhodium, silver or gold.

External concave reflecting element 14 is for reflecting and collimating light transmitted from within sealed arc chamber 12 by transparent tube 26, in a direction parallel to center axis C of sealed arc chamber 12 and out of short arc lamp 10.

According to the preferred embodiment of short arc lamp 10, external reflecting element 14 features about the same focal point 56 as that of internal integral reflecting element 24, preferably located near or at the end of cathode tip 50 on center axis C.

Consequently, external reflecting element 14 reflects and collimates light flux 59 transmitted through transparent tube 26 of arc chamber 12, in the same direction as internal integral reflecting element 24 reflects and collimates light flux 57 through window 30 of arc chamber 12.

External reflector 14 is positioned and secured with respect to sealed arc chamber 12 by the use of a frame 18 which includes a flat peripheral ring 18', a plurality of thin flat arms 15, which are positioned with their face parallel to the direction of propagation of beam 60 in order as not to obstruct the light output and a window band 16.

Frame 18 and its components are made of a light rigid metal such as aluminum.

Figure 3:
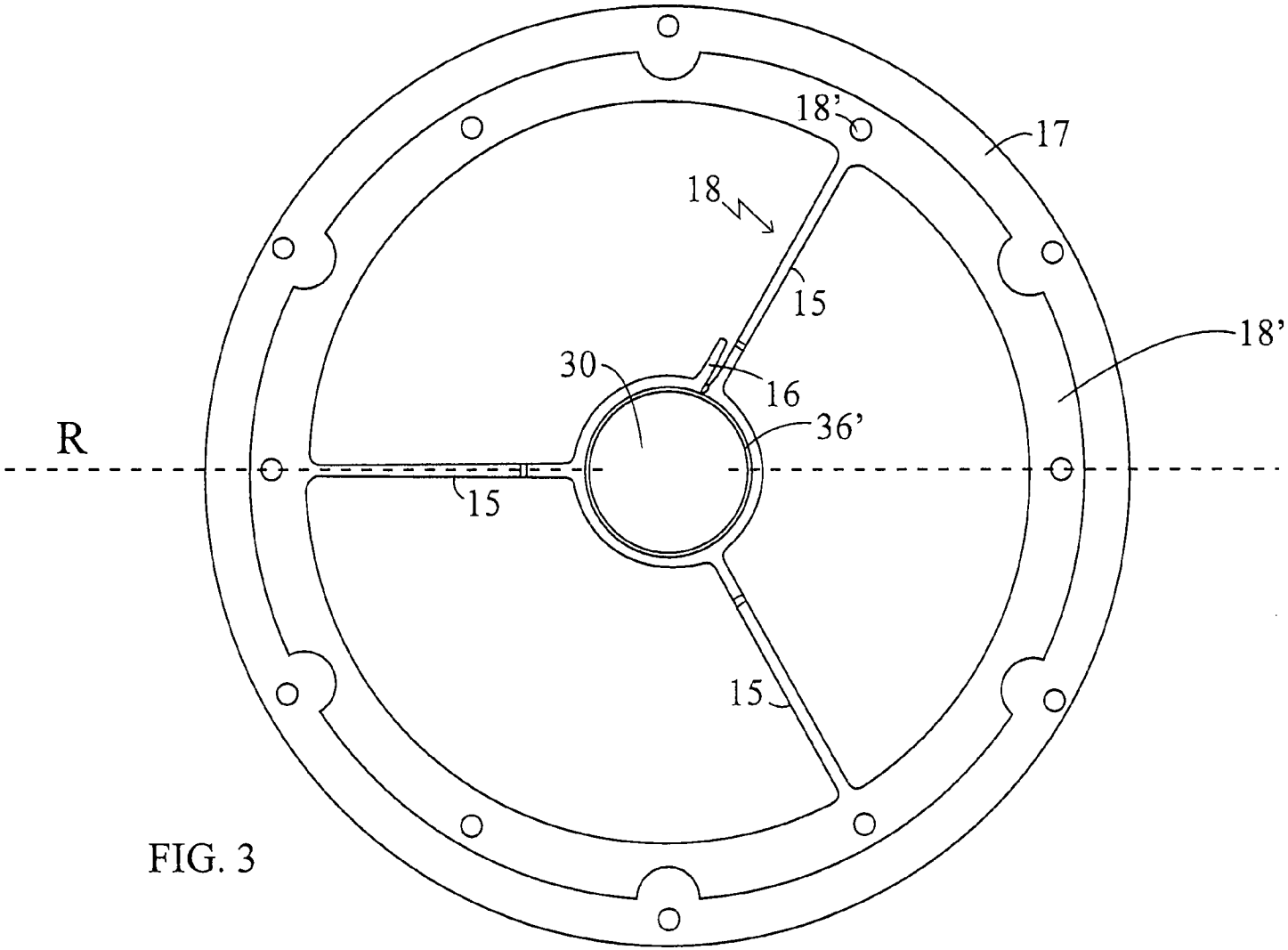

A front view of the sealed arc chamber/external reflector assembly is shown in FIG. 3 to which reference is now made. Window band 16 of frame 18 embraces securely window end 36' of cathode/window sleeve 36, to attach frame 18 to sealed arc chamber 12.

Ring 18' is attached via holes 18" to a lamp housing 17 which is a closed structure with an opening at its front. Arc lamp housing 17 has a rectangular or any other curvilinear frame configuration and is preferably made of a metal such as aluminum, but may also be made of other material e.g. ceramics or a heat resistant rigid plastic.

Arc lamp housing 17 accommodates firmly edge 14" of reflector 14. On its opposite face, lamp housing 17 secures firmly base 40 of sealed short arc chamber 12, via a sealed arc chamber socket (not shown).

Thus, a rigid construction is formed in which reflector 14 is positioned stationary and holds firmly with respect to short arc chamber 12.

Prior to the final fixing of the short arc assembly, during beam alignment, the position of focal point of external reflector 14 can be varied with respect to the position of the focal point of internal reflector 24 by sliding window band 16 back and forth on top of window edge 36' of cathode/window sleeve 36, and a simultaneous co-linear sliding of base 40 in the sealed arc chamber socket.

Beam Characteristics

According to the above description of short arc lamp 10, there is substantial flexibility with respect to selecting different types of materials and dimensions of the components of short arc lamp 10, and flexibility with respect to selecting different operating conditions for operating short arc lamp 10, suitable to a particular application.

Without reciting all the various different combinations and permutations of using different types of materials and dimensions for forming a vast variety of different particular forms of the generally disclosed short arc lamp 10, operated at a variety of different operating conditions, general operation of short arc lamp 10 of the present invention is herein described, followed by a few selected particular examples.

Referring again to FIG. 1, sealed arc chamber 12 is evacuated and then pressurized with gas by using gas transport line 32 connecting sealed arc chamber 12 to appropriate gas handling and supply equipment (not shown). A power supply device (not shown) connected to appropriately configured and positioned connections to anode 20 and cathode 22 is used for generating a voltage across arc gap 52 equal to or greater than the breakdown voltage across arc gap 52, according to the particular types of materials, geometrical configuration, and parameters of short arc lamp 10.

Power supplied to short arc lamp 10 is in any form of power suitable to a short arc lamp known in the art, e.g. in a form of a constant voltage, a pulsed voltage, an alternating voltage, a constant current, a pulsed current, or an alternating current.

In any of these cases the power delivery mechanism has at least two phases:

In the first phase the breakdown voltage, necessary to ignite the arc, is established between the electrodes while in the second phase a sustaining current at a much lower voltage is provided, which keeps the arc alive across arc gap 52.

An electrical potential is thereby established between anode 20 and cathode 22. Concomitant with establishment of the electrical current across arc gap 52 is excitation of gas 32 along with generation or emission of light in the immediate vicinity of arc gap 52.

Part of the light, e.g. ray 57, generated at arc gap 52 diverges onto and is reflected and collimated by reflective surface 24' of internal integral concave reflecting element 24.

Due to the parabolic geometry of internal integral concave reflecting element 24, this collimated light is in the form of parallel light rays 53, parallel to center axis C of sealed arc chamber 12, emerging towards the anode direction passing through transparent window 30, and exiting short arc lamp 10.

Simultaneously, other part of the light, e.g. ray 59, generated at arc gap 52 is transmitted through transparent tube 26 diverges onto and is reflected and collimated by, reflective surface 14' of external concave reflecting element 14.

Due to the parabolic geometry of external concave reflecting element 24, this collimated light is also in the form of parallel light rays 60, parallel to center axis C of sealed arc chamber 12, passing through void volume between sealed arc chamber 12 and external concave reflecting element 14 and exiting short arc lamp 10.

The result is an out-coming beam of light 61 with a diameter of about 20 cm. or larger (at window 30 plane), which is superimposed from two concentric beams of light 59 and 60, and which has substantially a flat light intensity distribution and a beam divergence of about 2 degrees or higher, wherein this divergence is a consequence of a final gap size, non-perfect optical components and unavoidable tolerances in optical alignment.

By adjusting the location of the discharge gap with respect to the focal point of external reflecting element 14 which was described above, the intensity profile of out-coming beam 61 can be widely adjusted.

Configuration and operation of short arc lamp 10 according to the present invention therefore provide a relatively high total light energy and total collimated light flux density because of an improved collection of light, compared to previous lamp configurations and allows for a reduced size of the lamp, compared to lamp configuration that lacks the internal reflector and transparent tube/transparent window combination.

Moreover, having both a transparent wall and transparent window allows for flexibility in selecting the transparent material, e.g. sapphire for the transparent tube, which allows transmission of radiation of light wavelength between 0.4 μm and about 6 μm and Zinc Sulfide for the transparent window, which transmits wavelength of up to 14 μm. Thus, a composite ray of light with two separate wavelength bands can be obtained.

EXAMPLES

An important feature of the present invention is that short arc lamp 10 is configured for providing a light source having variable and controllable characteristics of magnitude and wavelength band of the total light energy exiting sealed arc chamber 12, in general, and exiting short arc lamp 10, in particular. Specifically, sealed arc chamber 12 features two pathways for light generated at arc gap 52 to exit short arc lamp 10.

A first pathway features light reflecting from internal integral concave reflecting element 24 and passing through transparent window 30, and a second pathway features light passing through transparent tube 26, reflecting from external concave reflecting element 14.

A first example of a particular embodiment of short arc lamp 10 is where transparent window 30 in sealed arc chamber 12 and transparent tube 26 are each made of materials which include sapphire or quartz.

In this case, the wavelength band of all the light energy exiting short arc lamp 10 by way of internal integral concave reflecting element 24 and passing through transparent window 30, and, by way of passing through transparent tube 26, reflecting from external concave reflecting element 14 is in the range of between about 0.2 microns to about 2.5 microns or between about 0.4 microns to about 6 microns (using quartz or sapphire respectively).

A second example of a particular embodiment of short arc lamp 10 is where transparent window 30 in sealed arc chamber 12 is made of a material selected from the group consisting of zinc sulfide, zinc selenide, or germanium, and where transparent tube 26 is made of materials which include sapphire or quartz.

In this case, the wavelength band of part of the light energy exiting short arc lamp 10 via internal integral concave reflecting element 24 and passing through transparent window 30 extends to the mid-infrared and, the wavelength band of the remaining part of the light energy exiting short arc lamp 10 via external concave reflecting element 14 is in the range of about 0.2 microns to about 2.5 microns or between about 0.4 microns to about 6 microns (using quartz or sapphire respectively).

A third example of a particular embodiment of short arc lamp 10 is where transparent window 30 in sealed arc chamber 12 is made of materials which include sapphire or quartz, and, where transparent tube 26 is made of tube which includes zinc sulfide.

In this case, the wavelength band of part of the light energy exiting short arc lamp 10 by way of internal integral concave reflecting element 24 and passing through transparent window 30 is in the range of between about 0.2 microns to about 2.5 microns or between about 0.4 microns to about 6 microns (using quartz or sapphire respectively), and the wavelength band of the remaining part of the light energy passing transparent tube 25 and exiting short arc lamp 10 via external integral concave reflecting element 14 is between about 0.4 to about 14 microns.

A fourth example of a particular embodiment of short arc lamp 10 is where both transparent window 30 in sealed arc chamber 12 and transparent tube 26 are each made of a glass selected from the group consisting of zinc sulfide, zinc selenide, or germanium. In this case, the wavelength band of all the light energy exiting short arc lamp 10 by way of internal integral concave reflecting element 24 and passing through transparent window 30, and, by way of passing through transparent tube 26, reflecting from external concave reflecting element 14 extends to the range of the mid-infrared.

While the invention has been described with respect to a limited number of embodiments and examples thereof, it will be appreciated that many variations, modifications and other applications of the invention may be made without departing from the spirit and scope of the invention.

What is claimed is:

1. A short arc lamp comprising:

(a) a sealed transparent arc chamber having an internal reflecting element, said sealed transparent arc chamber configured to emit an inner light beam, wherein said inner light beam corresponds to light reflected from said internal reflecting element, and (b) an external reflecting element, positioned external to said sealed transparent arc chamber, wherein said sealed transparent arc chamber is configured to emit an outer light beam having an outer-beam wavelength band, wherein said outer light beam corresponds to light reflected from said external reflecting element without first impinging upon said internal reflecting element, and wherein said sealed transparent arc chamber is further configured to separately control an inner-beam wavelength band and said outer-beam wavelength band of an out-coming composite light beam.

2. The short arc lamp as in claim 1 wherein said sealed transparent arc chamber includes:

(i) an anode extending lengthwise along center axis of said sealed transparent arc chamber;

(ii) a cathode extending lengthwise along said center axis of said sealed transparent arc chamber, whereby tip of said cathode faces oppositely to a tip of said anode, said anode and said cathode are separated by a gap defining an arc gap of the short arc lamp;

(iii) a transparent tube extending lengthwise along and symmetrical wit respect to said center axis of said sealed transparent arc chamber, for providing a volume to said sealed transparent arc chamber, said volume of said transparent tube confines said anode, said cathode, and said internal reflecting element, said transparent tube transmits at least part of light generated within said sealed transparent arc chamber outwards;

(iv) a base, tightly joined to an anode end of said transparent tube, extending parallel to said radial axis of said sealed transparent arc chamber substantially across inner diameter of said transparent tube, for supporting said internal reflecting element and said anode, and for enabling gas tight closure of a anode end of said sealed transparent arc chamber, and (v) a transparent window tightly joined to a cathode end of said transparent tube, substantially cylindrically configured with diameter parallel to said radial axis extending substantially across said inner diameter of said transparent tube, for transmitting light reflected and collimated by said internal reflecting element out of the short arc lamp and for enabling gas tight closure of cathode end of said sealed transparent arc chamber.

3. The short arc lamp as in claim 2 wherein said internal reflecting element is positioned internal and integral to said sealed transparent arc chamber, symmetrically mounted around said anode, concave in direction of said cathode, and symmetrical with respect to said center axis of said sealed transparent arc chamber, for reflecting and collimating light generated within said sealed transparent arc chamber in a direction of said cathode, and out of the short arc lamp through said window.

4. The short arc lamp as in claim 2 wherein said sealed transparent arc chamber further includes:

(vi) a gas occupying void volume of said volume of said sealed transparent arc chamber for being excited by a short arc formed across said arc gap of the short arc lamp; and (vii) a gas transport line hermetically sealed into and extending through said base, for transporting said gas into and out of said void volume of said scaled transparent arc chamber.

5. The short arc lamp of claim 1 wherein a focal point of said external reflecting element nearly coincides with a focal point of said internal reflecting element.

6. The short arc tamp of claim 2 wherein said external reflecting element is symmetrically mounted around a wall of said transparent tube, is concave having concavity such as said concavity of said internal reflecting element.

7. The short arc lamp of claim 2 wherein said anode is made of a material selected from the group consisting of tungsten, molybdenum, tantalum, carbon and combination thereof.

8. The short arc lamp of claim 2 wherein said cathode is made of a material selected from the group consisting of tungsten, thoriated tungsten, carbon and lanthanum hexaboride.

9. The short arc lamp of claim 1 wherein said internal reflecting element is made of a material selected from the group consisting of copper, nickel, aluminum and combination thereof.

10. The short arc lamp of claim 1 wherein said external reflecting element is made of a material selected from the group consisting of copper, nickel, aluminum, ceramics and plastic.

11. The short arc lamp of claim 2 wherein said base is made of stainless steel.

12. The short arc lamp of claim 2 wherein said window is made of a material selected from the group consisting of quartz, sapphire, zinc sulfide, zinc selenide, germanium and a combination thereof.

13. The short arc lamp of claim 2 wherein said transparent tube is made of a material selected from the group consisting of quartz, sapphire, zinc sulfide, and combination thereof.

14. The short arc lamp of claim 4 wherein said gas is selected from the group consisting of xenon, argon, neon and combination thereof.

15. The short arc lamp of claim 4 wherein pressure of said gas is between about 0.1 atmospheres to about 20 atmospheres.

16. The short arc lamp as in claim 1 further comprising:

(c) a circular frame used to attach said sealed transparent arc chamber to said external reflecting element, and (d) an arc lamp housing having a socket for holding said sealed transparent are chamber.

17. The short arc lamp as in claim 16 wherein said circular frame is attached to said sealed transparent arc chamber at a center of said circular frame, and to said arc lamp housing at a periphery of said circular frame.

18. The short arc lamp as in claim 17 wherein said socket of said arc lamp housing supports a base of said sealed transparent are chamber.

19. The short arc lamp of claim 1 wherein said out-coming composite light beam has a divergence of at least about 2°.

20. The short arc lamp of claim 1 wherein said out-coming composite light beam has a diameter of at least about 2 cm.

21. The short arc lamp of claim 1 wherein said inner-beam wavelength band is different from said outer-beam wavelength band.

22. The shod arc lamp of claim 1 wherein said inner-beam wavelength band is in the infra-red spectral range and said outer-beam wavelength band is in the uv/visible spectral range.

23. The short arc lamp of claim 1 wherein said inner-beam wavelength band is in the uv/visible spectral range and said outer-beam wavelength band is in the infra-red spectral range.

24. The short arc lamp of claim 4 wherein an arc through said gas is ignited by electrical means selected from the group consisting of constant voltage, voltage pulses, alternating voltage and combination thereof.

25. The short arc lamp of claim 24 wherein said arc is sustained by electrical means selected from the group consisting of constant current, pulsed current, alternating current and combination thereof.

* * * * *

UNITED STATES PATENT AND TRADEMARK OFFICE

CERTIFICATE OF CORRECTION

PATENT NO. : 7,355,328 B2
APPLICATION NO. : 10/508080
DATED : April 8, 2008
INVENTOR(S) : Shabtai Botzer et al.

It is certified that error appears in the above-identified patent and that said Letters Patent is hereby corrected as shown below:

Claim 2, column 9 should be corrected as follows:
Line 61, please change “wit” to read --with--

Claim 4, column 10 should be corrected as follows:
Line 33, please change “scaled” to read --sealed--

Claim 16, column 11 should be corrected as follows:
Line 11, please change “are” to read --arc--

Claim 18, column 11 should be corrected as follows:
Line 11, please change “are” to read --arc--

Claim 22, column 12 should be corrected as follows:
Line 4, please change “shod” to read --short--

Signed and Sealed this

Twenty-fourth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,355,328 B2
APPLICATION NO. : 10/508080
DATED : April 8, 2008
INVENTOR(S) : Shabtai Botzer et al.

It is certified that error appears in the above-identified patent and that said Letters Patent is hereby corrected as shown below:

Claim 2, column 9 should be corrected as follows:
Line 61, please change “wit” to read --with--

Claim 4, column 10 should be corrected as follows:
Line 33, please change “scaled” to read --sealed--

Claim 16, column 11 should be corrected as follows:
Line 11, please change “are” to read --arc--

Claim 18, column 11 should be corrected as follows:
Line 17, please change “are” to read --arc--

Claim 22, column 12 should be corrected as follows:
Line 4, please change “shod” to read --short--

This certificate supersedes the Certificate of Correction issued June 24, 2008.

Signed and Sealed this

Twenty-second Day of July, 2008

JON W. DUDAS
*Director of the United States Patent and Trademark Office*